US010450156B2

(12) United States Patent
Mizuno

(10) Patent No.: US 10,450,156 B2
(45) Date of Patent: Oct. 22, 2019

(54) IMAGE FORMING APPARATUS

(71) Applicant: Brother Kogyo Kabushiki Kaisha, Nagoya-shi, Aichi-ken (JP)

(72) Inventor: Yusuke Mizuno, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 611 days.

(21) Appl. No.: 15/086,117

(22) Filed: Mar. 31, 2016

(65) Prior Publication Data

US 2016/0289027 A1 Oct. 6, 2016

(30) Foreign Application Priority Data

Mar. 31, 2015 (JP) ..... 2015-072607

(51) Int. Cl.
*B65H 85/00* (2006.01)
*B65H 7/06* (2006.01)
(Continued)

(52) U.S. Cl.
CPC ..... *B65H 7/06* (2013.01); *B65H 7/14* (2013.01); *B65H 43/00* (2013.01); *B65H 43/08* (2013.01);
(Continued)

(58) Field of Classification Search
CPC . B65H 7/06; B65H 7/14; B65H 43/00; B65H 85/00
See application file for complete search history.

(56) References Cited

U.S. PATENT DOCUMENTS 4,928,150 A 5/1990 Hatta
6,539,198 B2 3/2003 Miyajima
(Continued)

FOREIGN PATENT DOCUMENTS

JP S63-113581 A 5/1988
JP S63-265252 A 11/1988
JP 2002-037540 A 2/2002
JP 2011-090277 A 5/2011

OTHER PUBLICATIONS

May 22, 2018—(JP) Notification of Reasons for Rejection—App 2015-072607, Eng Tran.
Dec. 3, 2018—(CN) Notification of First Office Action—App 201610196749.7, Eng Tran.

*Primary Examiner* — Thomas A Morrison
(74) *Attorney, Agent, or Firm* — Banner & Witcoff, Ltd.

(57) ABSTRACT

An image forming apparatus having a controller and capable of forming images in double-face printing is provided. The controller conducts a measuring process to measure a time period corresponding to a sheet length; a comparison process to compare a measured value with a switch threshold value being a value in a range of a measurement error allowed to the measured value; and one of a first conveying process, in which a conveying unit is driven to convey a predetermined number of sheets circulating in a conveying path, and a second conveying process, in which the conveying unit is driven to convey a greater number of sheets than the predetermined number circulating in the conveying path. The controller conducts the first conveying process when the measured value is greater than the switch threshold value and conducts the second conveying process when the measured value is smaller than the switch threshold value.

10 Claims, 6 Drawing Sheets

(51) Int. Cl.

| | |
|---|---|
| ***B65H 7/14*** | (2006.01) |
| ***B65H 43/00*** | (2006.01) |
| ***B65H 43/08*** | (2006.01) |
| ***G03G 15/23*** | (2006.01) |
| ***G03G 15/00*** | (2006.01) |

(52) U.S. Cl.

CPC ..... *B65H 85/00* (2013.01); *G03G 15/234* (2013.01); *G03G 15/55* (2013.01); *G03G 15/70* (2013.01); *B65H 2220/09* (2013.01); *B65H 2511/11* (2013.01); *B65H 2511/30* (2013.01); *B65H 2511/51* (2013.01); *B65H 2511/515* (2013.01); *B65H 2511/528* (2013.01); *B65H 2513/53* (2013.01); *B65H 2553/612* (2013.01); *B65H 2801/06* (2013.01); *G03G 15/6552* (2013.01); *G03G 2215/00721* (2013.01)

(56) References Cited

U.S. PATENT DOCUMENTS

| | | | | |
|---|---|---|---|---|
| 6,655,680 | B1 * | 12/2003 | Huang | B65H 7/02 271/152 |
| 8,538,309 | B2 | 9/2013 | Ban | |
| 8,746,685 | B1 * | 6/2014 | Fukuzawa | B65H 29/58 271/184 |
| 2002/0018679 | A1 | 2/2002 | Miyajima | |
| 2011/0076076 | A1 * | 3/2011 | Ban | G03G 15/234 399/364 |

* cited by examiner

IMAGE FORMING APPARATUS

CROSS REFERENCE TO RELATED APPLICATION

This application claims priority from Japanese Patent Application No. 2015-072607, filed on Mar. 31, 2015, the entire subject matter of which is incorporated herein by reference.

BACKGROUND

Technical Field

An aspect of the present disclosure relates to an image funning apparatus capable of forming images in a double-face printing mode, in which images may be formed on both sides of a sheet.

Related Art

An image forming apparatus, which may adjust a number of sheets to be carried circulating inside the image forming apparatus during double-face printing depending on a sheet length, is known. The sheet length may refer to a dimension of an area in a sheet being conveyed in the image forming apparatus in parallel with a conveying direction.

The number of sheets to be carried circulating inside the image forming apparatus may affect image forming efficiency: as the number of sheets carried circulating in the image forming apparatus increases to be larger, a number of sheets to be processed for image forming per unit time may increase. In other words, the larger the number of circulative sheets increases, the higher the image forming efficiency improves.

Meanwhile, the number of circulative sheets may be determined by the sheet length. Therefore, the shorter the sheet length is, the larger the number of circulative sheets increases; and the longer the sheet length is, the smaller the number of circulative sheets decreases.

In this regard, an image forming apparatus may be equipped with sheet-length detector, and based on a detected sheet length, the image forming apparatus may be selectively driven in one of different conveying modes: a first conveying mode, in which a smaller number of (e.g., two) sheets may circulate, and a second conveyer mode, in which a larger number of (e.g., three) sheets may circulate.

SUMMARY

However, the sheet length detected by the sheet-length detector include an error. Therefore, if the sheet-lengths substantially approximate to a threshold length are detected, the conveying modes may be switched unnecessarily frequently. The threshold length may refer to a border sheet length, which may be referred to in order to determine the conveying modes between the first conveying modes and the second conveying mode.

The present disclosure is advantageous in that an image forming apparatus, in which unnecessarily frequent switching actions to switch conveying modes may be restrained, is provided.

According to an aspect of the present disclosure, an image forming apparatus is provided. The image funning apparatus includes an image forming unit configured to form an image on a sheet; a sheet tray, on which the sheet to be conveyed to the image forming unit is placed; a discharge tray, on which the sheet being discharged with the image formed thereon is placed; and a conveying unit configured to convey the sheet in a conveying path along a sheet conveying direction. The conveying path includes a first conveying path extending from the sheet tray through the image forming unit to the ejection tray; and a second conveying path branched from the first conveying path at a position downstream from the image forming unit with regard to the sheet conveying direction and merged with the first conveying path at a position upstream from the image forming unit with regard to the sheet conveying direction. The image forming apparatus further includes a sheet sensor configured to output a first signal when no sheet is at a predetermined position in the conveying path and to output a second signal when the sheet is at the predetermined position; a memory device; and a controller. The controller is configured to conduct a measuring process, in which a time period between timing when signals output from the sheet sensor change from the first signal to the second signal and timing when signals output from the sheet sensor change from the second signal to the first signal is measured; a comparison process, in which a measured value indicating the time period measured in the measuring process is compared with a switch threshold value stored in the memory device, the switch threshold value being a value in a range of a measurement error allowed to the measured value for the sheet; and a conveying process, in which the conveying unit is driven to convey a number of sheets circulating in the conveying path, the conveying process including a first conveying process, in which the conveying unit is driven to convey a predetermined number of sheets circulating in the conveying path; and a second conveying process, in which the conveying unit is driven to convey a greater number of sheets than the predetermined number circulating in the conveying path. In the conveying process, the controller conducts the first conveying process when the measured value is greater than the switch threshold value and conducts the second conveying process when the measured value is smaller than the switch threshold value.

BRIEF DESCRIPTION OF THE ACCOMPANYING DRAWINGS

DETAILED DESCRIPTION

Hereinafter, an image forming apparatus 1 according to an embodiment of the present disclosure will be described with reference to the accompanying drawings. It is noted that various connections are set forth between elements in the following description. These connections in general, and unless specified otherwise, may be direct or indirect, and this specification is not intended to be limiting in this respect. Aspects of the present disclosure may be implemented on circuits, such as application specific integrated circuits (ASICs), or in computer software as programs storable on computer-readable media including, but not limited to, RAMs, ROMs, flash memories, EEPROMs, CD-media, DVD-media, temporary storage, hard disk drives, floppy drives, permanent storage, and the like.

In the following description, identical parts or items may be referred to by a same reference sign, and redundant explanation of those will be omitted. A quantity of each element, part, or item is, unless specified otherwise, at least one. The present embodiment may not necessarily be limited to the embodiment described below.

First Embodiment

1. Overall Configuration of the Image Forming Apparatus

Figure 1:
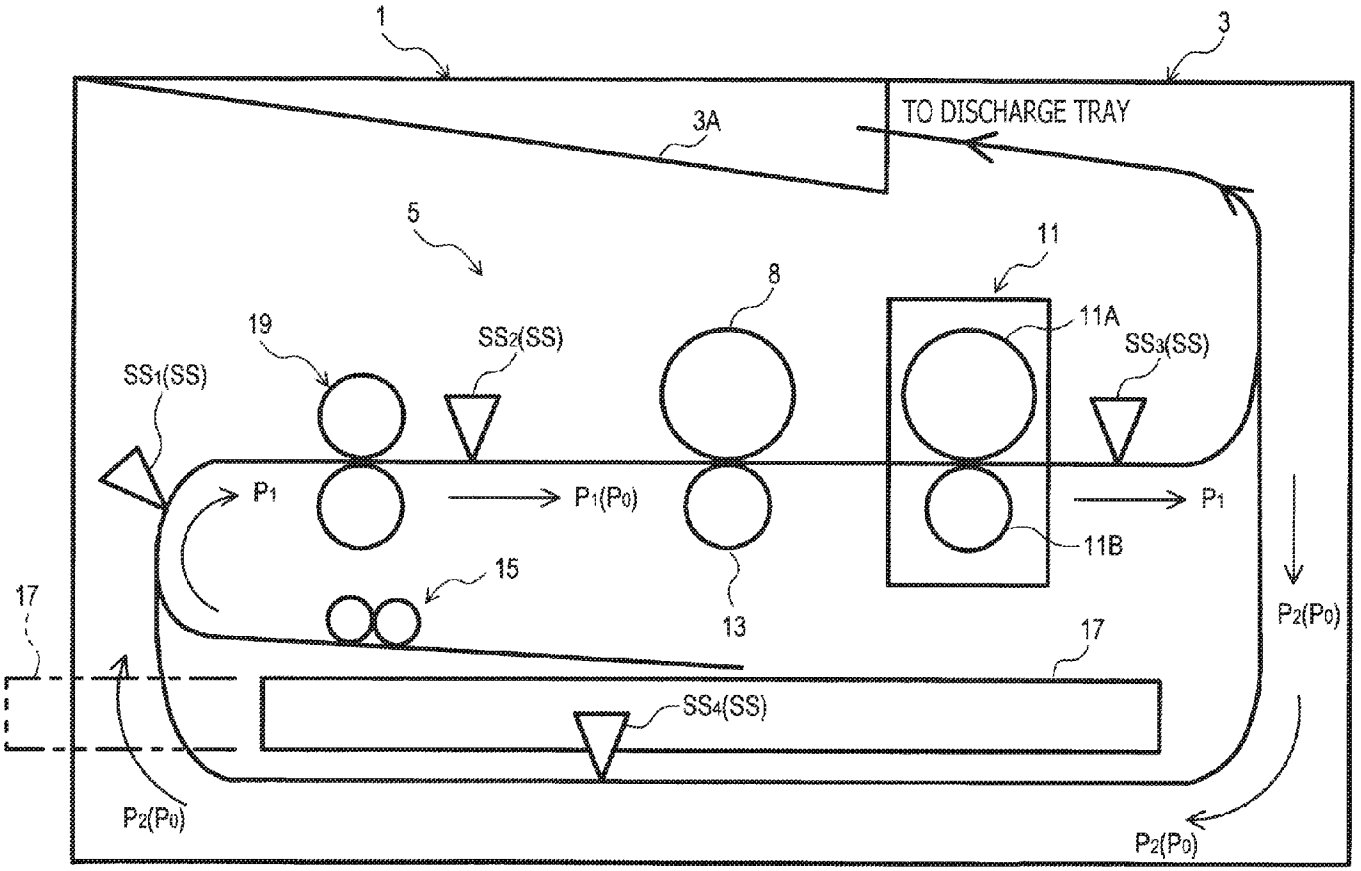
FIG. 1 illustrates an overall configuration of an image forming apparatus 1 according to an embodiment of the present disclosure.

The image forming apparatus 1 may be a monochrome printing apparatus, which is connectable with an external computer (not shown). As shown in FIG. 1, the image funning apparatus 1 includes a chassis 3, which accommodates an image forming unit 5 to form an image on a sheet. The image funning unit 5 may be an electro-photographic printing unit having a photosensitive drum 8 and a fixing unit 11.

The photosensitive drum 8 carries an image formed in a developer agent on a surface thereof. In a position to face with the photosensitive drum 8, arranged is a transfer roller 13. The transfer roller 13 serves to transfer the image carried on the photosensitive drum 8 onto the sheet when the sheet is conveyed between the photosensitive drum 8 and the transfer roller 13. The fixing unit 11 thermally fixes the image in the developer agent transferred onto the sheet thereat. The fixing unit 11 includes a heat roller 11A and a pressure roller 11B.

The heat roller 11A heats the developer agent, either directly or indirectly. The pressure roller 11B presses the sheet against the heat roller 11A. The fixing unit 11 conveys the sheet toward a discharge tray 3A, on which the sheet with the image formed thereon is placed.

In an upstream position from the image forming unit 5 with regard to a conveying direction, arranged is a feeder unit 15. The feeder unit 15 feeds sheets placed on a feeder tray 17 one-by-one to the image forming unit 5. On the feeder tray 17, one or more sheets to be fed to the image forming unit 5 may be placed.

The feeder tray 17 is movable between a sheet-feeding position, which is indicated by solid lines in FIG. 1, and a sheet-refilling position, which is indicated by dash-and-dots lines in FIG. 1. The sheets may be fed by the feeder unit 15 to the image forming unit 5 when the feeder tray 17 is in the sheet-feeding position.

The sheet-refilling position is a position, in which the feeder tray 17 is drawn outside the image forming apparatus 1 substantially along a horizontal direction. A user may refill the feeder tray 17 with sheets, which are in one of at least two types, when the feeder tray 17 is in the sheet-refilling position. A motion to place the feeder tray 17 in the sheet-refilling position may be referred to as an opening motion, and a motion to place the feeder tray 17 in the sheet-feeding position may be referred to as a closing motion. In a neighboring position from the feeder tray 17, arranged is a tray sensor SS5 (see FIG. 3) to detect the feeder tray 17 being in the sheet-feeding position.

The image forming apparatus 1 may provide a single-face printing function, by which an image may be formed solely on a single side, and a double-face printing function, by which images may be formed on both sides of the sheet. When a single-face printing operation is performed, the sheet is conveyed from the feeder tray 17 through the image forming unit 5 to the discharge tray 3A along a first conveying path P1. When a double-face printing operation is performed, the sheet is primarily conveyed from the feeder tray 17 to the image forming unit 5 to have an image printed on a first side of the sheet. Thereafter, the sheet is secondarily conveyed through a second conveying path P2 to return to the image forming unit 5 and have another image formed on a second side of the sheet. The sheet is thereafter discharged from the chassis 3 and settled at the discharge tray 3A.

The second conveying path P2 branches from the first conveying path P1 at a position downstream from the image forming unit 5 with regard to the sheet conveying direction and merges with the first conveying path P1 at a position upstream from the image forming unit 5, for example, at a position upstream from a pair of registration rollers 19, with regard to the sheet conveying direction.

In the following description, the first conveying path P1 and the second conveying path P2 may be collectively referred to as a conveying path P0. The sheets may be conveyed along the conveying path P0 by a conveying unit 6 (see FIG. 3), which includes the feeder unit 15 and the pair of registration rollers 19.

The pair of registration rollers 19 are arranged at a position upstream from the image forming unit 5, for example, at a position upstream from the photosensitive drum 8, to correct an orientation of the sheet to be fed to the image forming unit 5. Along the conveying path P0, arranged is a sheet sensor SS to detect presence or absence of the sheet at predetermined positions in the conveying path P0. The sheet sensor SS includes a first sheet sensor SS1, a second sheet sensor SS2, a third sheet sensor SS3, and a fourth sheet sensor SS4.

The first sheet sensor SS1 detects presence or absence of the sheet at a position upstream from the registration rollers 19 with regard to the sheet conveying direction. The second sheet sensor SS2 detects presence or absence of the sheet at a position downstream from the registration rollers 19 with regard to the sheet conveying direction. The third sheet sensor SS3 detects presence or absence of the sheet at a position downstream from the fixing unit 11 with regard to the sheet conveying direction. The fourth sheet sensor SS4 detects presence or absence of the sheet in the second conveying path P2.

2. Electrical Configuration of the Image Forming Apparatus

Figure 3:
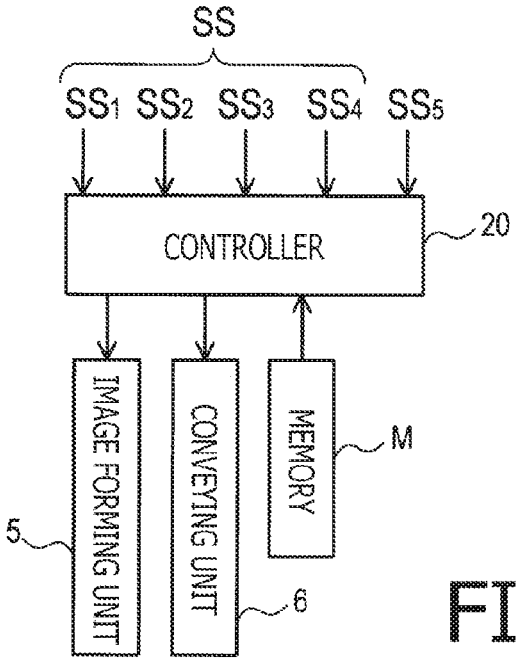
FIG. 3 is a block diagram to illustrate a controlling system in the image forming apparatus 1 according to the embodiment of the present disclosure.

Behaviors of the conveying unit 6 is controlled by a controller 20 (see FIG. 3). The controller 20 may control behaviors of the image forming unit 5. The controller 20 may include a microcomputer having a central processing unit (CPU), a read-only memory (ROM), and a random-access memory (RAM).

The conveying unit 6 and the image forming unit 5 may be controlled by the controller 20 according to a program, which may be stored in a non-volatile memory device such as the ROM. The controller 20 may activate and control the conveying unit 6 and the image forming unit 5 in response to a command for image forming transmitted from, for example, the external computer connected with the image forming apparatus 1 through a network.

The controller 20 is connected with a memory M, which is a storage device to store information. The controller 20 may read information from the memory M and write information in the memory M.

The controller 20 is connected with the tray sensor SS5 and the sheet sensor SS. The tray sensor SS5 is a switch sensor, which outputs a low-leveled signal when the tray sensor SS5 is pushed by the feeder tray 17 being moved from the sheet-refilling position to the sheet-feeding position to the controller 20, and outputs a high-leveled signal when the tray sensor SS5 is released from the feeder tray 17 being moved from the sheet-feeding position to the sheet-refilling position to the controller 20.

Meanwhile, the sheet sensor SS outputs different signals depending on presence and absence of the sheet in the conveying path P0. The sheet sensor SS may output a high-leveled signal when absence of the sheet is detected and a low-leveled signal when presence of the sheet is detected. In the following description, the high-leveled signal and the low-leveled signal from the sheet sensor SS may be referred to as a first signal and a second signal, respectively. Further, the low-leveled signal from the tray sensor SS5 may be referred to as a third signal.

Figure 2:
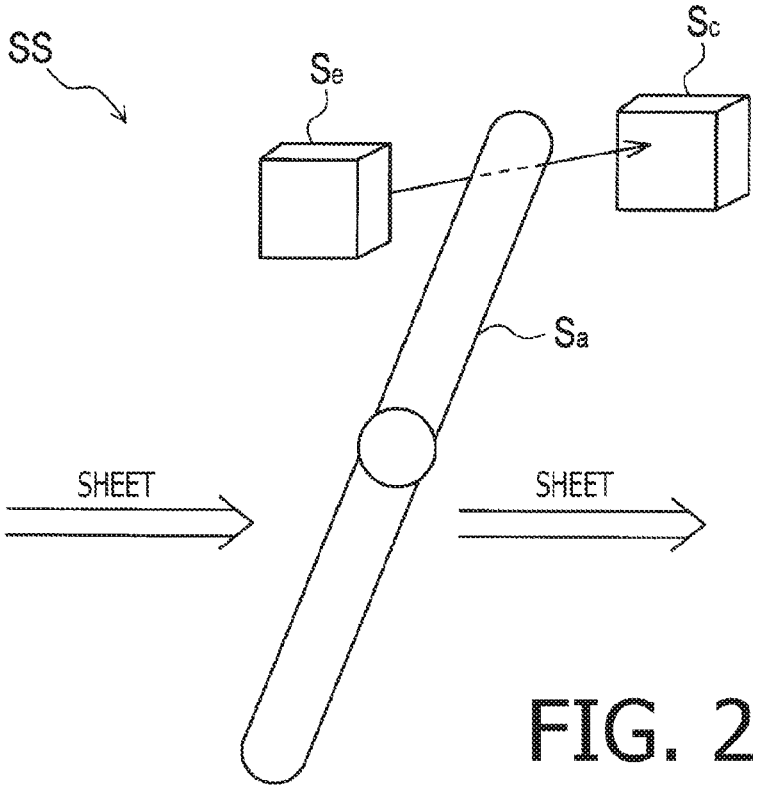
FIG. 2 illustrates a sheet sensor SS in the image forming apparatus 1 according to the embodiment of the present disclosure.

The sheet sensor SS may be an optical detector unit (see FIG. 2), including, for example, a light emitter Se, a light receiver Sc, and a movable member Sa. The movable member Sa is a piece arranged to extend from a position between the light emitter Se and the light receiver Sc through the conveying path P0. The movable member Sa is movable between a blocking position, in which light emitted from the light emitter Se toward the light receiver is blocked, and a transmitting position, in which the light from the light emitter Se is transmitted to the light receiver Sc.

For example, when there is no sheet to contact the movable member Sa, the movable member Sa is in the blocking position. Therefore, the sheet sensor SS outputs the high-leveled first signal to the controller 20. When a leading end of the sheet being conveyed in the conveying path P0 contacts the movable member Sa, the movable member Sa is moved by the sheet and tilt to the transmitting position. Therefore, the sheet sensor SS having output the first signal is switched to output the low-leveled second signal to the controller 20.

When the sheet is conveyed further and a trailing end of the sheet leaves the movable member Sa, the movable member Sa returns to the blocking position by, for example, urging force of a spring, which is not shown. Therefore, the sheet sensor SS having output the second signal is switched to output the higher-leveled first signal to the controller 20.

3. Controlling Behaviors by the Controller 3.1 Overall Control

After the signals output from the sheet sensor SS are switched from the first signal to the second signal, the controller 20 may conduct a measuring process, in which a sheet length of the sheet being conveyed is measured based on a time period until the signals from the sheet sensor SS are switched from the second signal to the first signal. The sheet length may refer to a dimension of an area in the sheet being conveyed in the conveying path P0 along a direction in parallel with the conveying sheet direction.

Thereafter, when double-face printing is performed, the controller 20 further conducts at least a comparison process, a first conveying process, and a second conveying process, which will be described below. In the comparison process, a measured value Dn obtained in the measuring process is compared with a switch threshold value T stored in the memory M. The switch threshold value T indicates a reference sheet length and is within a range of a measurement error E allowed to the measured value Dn. The measurement error E may be caused by, for example, irregular sheet thicknesses, timing deviation for the movable member Sa to move due to irregularity in conveying speeds which may vary minutely at each conveyance, and irregularity in sheet lengths.

In the comparison process, the controller 20 reads the switch threshold value T from the memory M. The switch threshold value T includes a first switch threshold value T1 and a second switch threshold value T2. The sign "n" in the measured value Dn indicates an index of the measured sheet and may be assigned on basis of a print job.

Figure 5:
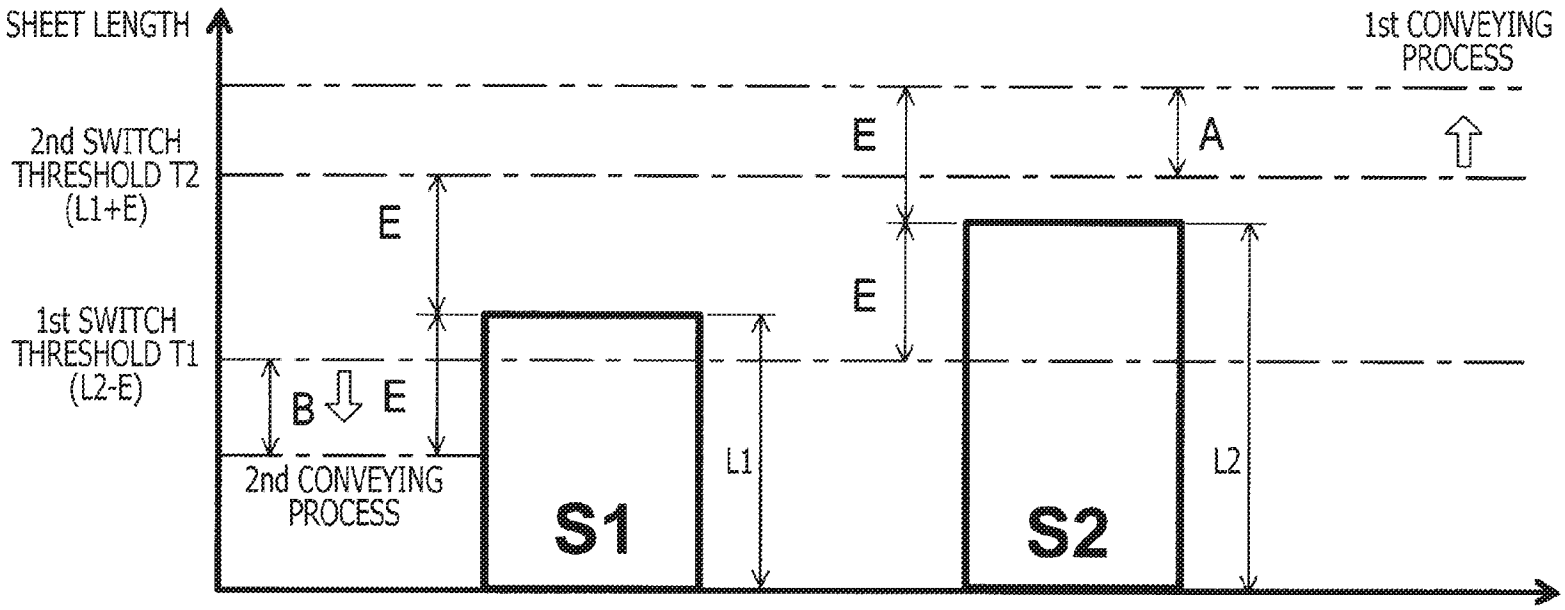
FIG. 5 illustrates relation among sheet lengths, switching thresholds, and conveying modes in the image forming apparatus according to a first embodiment of the present disclosure.

The feeder tray 17 may accommodate one of a first sheet S1, of which sheet length is a first sheet length L1, and a second sheet S2, of which sheet length is a second sheet length L2 being longer than the first sheet length L1 ($L1<L2$) (see FIG. 5). The switch threshold value T is set to satisfy an inequality: $L1-E<\text{switch threshold value } T<L2-E$.

The first sheet length L1 of the first sheet S1 is a length, by which the sheets circulating in the conveying path P0 in the second conveying process may likely be avoided from colliding and therefore may be avoided from being jammed. In the meantime, the second sheet length L2 of the second sheet S2 is a length, by which the sheets circulating in the conveying path P0 in the second conveying process may tend to collide with each other and therefore may cause sheet jam. In this regard, the second conveying process may carry a larger number of sheets circulating than the first conveying process.

The first switch threshold value T1 is set to satisfy inequalities: $L1-E<\text{first switch threshold value } T1\leq L2-E$, $L2-E\leq L1+E$. More specifically, the first switch threshold value T1 is greater than a minimum value for a first measurement error (L1−E) when the measurement process is performed with the first sheet S1 and is smaller than or equal to a minimum value for a second measurement error (L2−E) when the measurement process is performed with the second sheet S2. In this regard, the minimum value for the second measurement error (L2−E) is smaller than or equal to a maximum value for the first measurement value (L1+E).

Meanwhile, the inequality $L2-E\leq L1+E$ should indicate that the first sheet S1 and the second sheet S2 are in such relationship that the measurement error E for the first sheet S1 and the measurement error E for the second sheet S2 have a range that may coincide each other. Therefore, if the measured value Dn falls in the coincident range, the controller 20 may not be able to determine that the sheet being measured is the first sheet S1 or the second sheet S2. However, as described below, according to the embodiments of the present disclosure, while the different-typed sheets S1, S2 may not be identified, the double-face printing may be performed preferably.

In the present embodiment, the value L2−E is stored in the memory M as the first switch threshold value T1. Absolute values in the maximum value +E and the minimum value −E for the for the measurement error E may not necessarily be the same value, in other words, when the maximum value +E and the minimum value −E for the measurement error E are +E1 and −E2, respectively, there may be a case that E1 and E2 are different ($E1\neq E2$). Therefore, the range of the measurement error E for the first sheet S1 and the range of the measurement error E for the second sheet S2 may not coincide but may be different.

The second switch threshold value T2 is set to satisfy inequalities: L1+E≤ second switch threshold value T2<L2+E, L2−E≤L1+E. More specifically, the second switch threshold value T2 is smaller than a maximum value for a second measurement error (L2+E) when the measurement process is performed with the second sheet S2 and is greater than or equal to a maximum value for a first measurement error (L1+E) when the measurement process is performed with the first sheet S1. In this regard, the maximum value for the first measurement error (L1+E) is greater than or equal to a minimum value for the second measurement value (L2−E). In the present embodiment, the value L1−E is stored in the memory M as the second switch threshold value T2.

The first conveying process is conducted, when the measured value Dn is greater than the switch threshold value T, to drive the conveying unit 6 so that a predetermined number X of sheets should be carried circulating in the conveying path P0. The second conveying process is conducted, when the measured value Dn is smaller than the switch threshold value T, to drive the conveying unit 6 so that another predetermined number of sheets, which is greater than X, should be carried circulating in the conveying path P0. The predetermined number of the sheets to be carried circulating in the conveying path P0 may be referred to as a circulative number in the following description.

Meanwhile, the controller 20 may further conduct a sheet-jam detecting process, in which sheet jam in the conveying path P0 may be detected based on the signals output from the sheet sensor SS. For example, after the sheet sensor SS starts detecting the second signal indicating the presence of a sheet, and even after a time period longer than a time period required for the sheet to pass through the sheet sensor SS, the controller 20 may continuously receive the second signals. In this case, it may be assumed that the sheet is jammed in a position to tilt the movable member Sa of the sheet sensor SS; therefore, the controller 20 may determine that sheet jam has occurred.

The first conveying process and the second conveying process may be conducted, for example, in the following procedures. When the circulative number is 2 in the first conveying process, a first sheet is fed to the image forming unit 5, and an image for a second page is printed on a first side of the first sheet. The first sheet is conveyed to the second conveying path P2. Before the first sheet reenters the first conveying path P1, a second sheet is fed to the image forming unit 5, and an image for a fourth page is printed on a first side of the second sheet. At this point, two (2) sheets are circulating in the conveying path P0. The second sheet is conveyed to the second conveying path P2. Meanwhile, the first sheet reentering the first conveying path P1 is conveyed to the image forming unit 5, and an image for a first page is printed on a second side of the first sheet. The first sheet is discharged and settled at the discharge tray 3A. The second sheet reentering the first conveying path P1 is conveyed to the image forming unit 5, and an image for a third page is printed on a second side of the second sheet. The second sheet is discharged and settled at the discharge tray 3A. This series of conveying actions may be repeated for a third and following sheets, if any.

When the circulative number is 3 in the second conveying process, a first sheet is fed to the image forming unit 5, and an image for a second page is printed on a first side of the first sheet. The first sheet is conveyed to the second conveying path P2. Before the first sheet conveyed in the second conveying path P2 reenters the first conveying path P1, a second sheet is fed to the image forming unit 5, and an image for a fourth page is printed on a first side of the second sheet. The second sheet is conveyed to the second conveying path P2. Meanwhile, the first sheet reentering the first conveying path P1 is conveyed to the image forming unit 5, and an image for a first page is printed on a second side of the first sheet. Successively, a third sheet is fed to the image forming unit 5, and an image for a sixth page is printed on a first side of the third sheet. At this point, three (3) sheets are circulating in the conveying path P0. In the meantime, the first sheet is discharged and settled at the discharge tray 3A. The second sheet reentering the first conveying path P1 is conveyed to the image forming unit 5, and an image for a third page is printed on a second side of the second sheet. Before the third sheet conveyed in the second conveying path P2 reenters the first conveying path P1, a fourth sheet is fed to the image forming unit 5, and an image for an eighth page is printed on a first side of the fourth sheet. At this point, three (3) sheets are circulating in the conveying path P0. In the meantime, the second sheet is discharged and settled at the discharge tray 3A. The third sheet reentering the first conveying path P1 is conveyed to the image forming unit 5, and an image for a fifth page is printed on the second side of the third sheet. This series of conveying actions may be repeated for a fifth and following sheets, if any.

3.2 Detailed Control by the Controller

Figure 4:
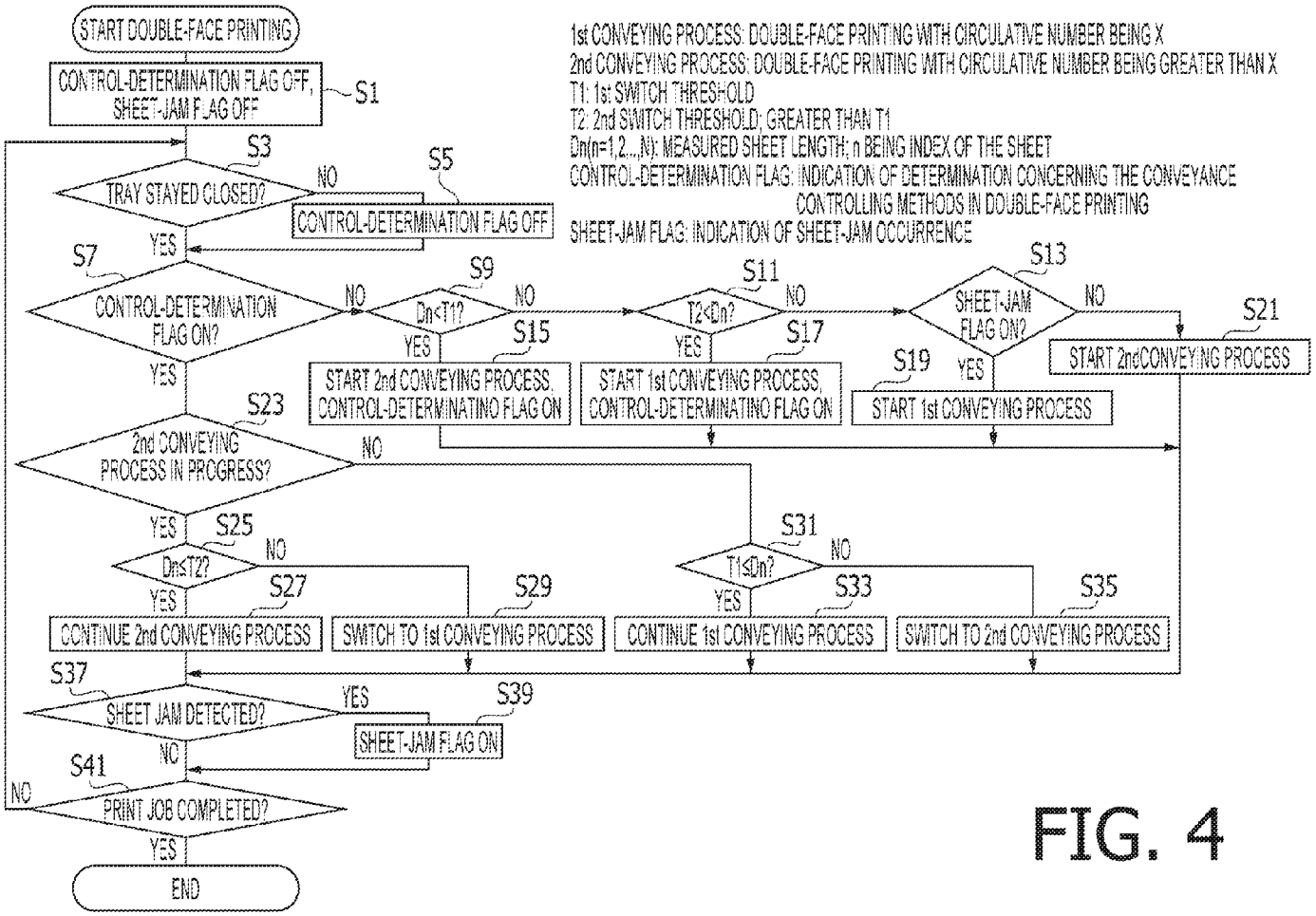
FIG. 4 is a flowchart to illustrate a controlling flow during double-face printing in the image forming apparatus according to the embodiment of the present disclosure.

The controller conducts a main flow of the double-face printing operation shown in FIG. 4. Programs to control the flow are stored in a non-volatile memory device, such as in the ROM. The flow is activated when a print job with double-face printing is transmitted from the external computer and received by the image forming apparatus 1 and the programs are read by the controller 20. As the print job starts, the controller 20 may conduct the measuring process to measure a sheet length of the sheet being conveyed based on the signals output from the sheet sensor SS and obtain a measured value Dn.

In the double-face printing operation, in S1, a control-determination flag and a sheet-jam flag are set off. The control-determination flag being on indicates that a conveyance controlling method for the double-face printing is determined. The sheet-jam flag being on indicates sheet jam being detected. Therefore, in S1, the controller 20 deletes information concerning the control-determination flag being on and the sheet-jam flag being on from the memory M.

In S3, the controller 20 determines whether the feeder tray 17 has stayed closed based on the output from the tray sensor SS5. If the feeder tray 17 has not stayed closed but has been moved to open (S3: NO), in S5, the controller 20 maintains the control-determination flag off. If the feeder tray 17 has stayed closed (S3: YES), in S7, the controller 20 determines whether the control-determination flag is on.

If the control-determination flag is not on (S7: NO), in S9, the controller 20 determines whether the measured value Dn is smaller than the first switch threshold value T1. If the measured value Dn is smaller than the first switch threshold value T1 (S9: YES), without experiencing to be greater than the second switch threshold value T2, in S15, the controller 20 conducts the second conveying process and sets the control-determination flag on. Therefore, information indicating the control-determination flag being on is stored in the memory M. The flow proceeds to S37.

If the measured value Dn is greater than or equal to the first switch threshold value T1 (S9: NO), in S11, the controller 20 determines whether the measured value Dn is greater than the second switch threshold value T2, without experiencing to be smaller than the first switch threshold value T1. If the measured value Dn is greater than the second switch threshold value T2 (S11: YES), in S17, the controller 20 conducts the first conveying process and sets the control-determination flag on. The flow proceeds to S37.

If the measured value Dn is smaller than or equal to the second switch threshold value T2 (S11: NO), in S13, the controller 20 determines whether the sheet-jam flag is on. If the sheet-jam flag is on (S13: YES), in S19, the controller 20 conducts the first conveying process. The flow proceeds to S37. If the sheet-jam flag is off (S13: NO), in S21, the controller 20 conducts the second conveying process. The flow proceeds to S37.

In S7, if the control-determination flag is on (S7: YES), in S23, the controller 20 determines whether the second conveying process is in progress. If the second conveying process is in progress (S23: YES), in S25, the controller 20 determines whether the measured value Dn is smaller than or equal to the second switch threshold value T2.

In S25, if the measured value Dn is smaller than or equal to the second switch threshold value T2 (S25: YES), in S27, the controller 20 continues the second conveying process. The flow proceeds to S37. If the measured value Dn is greater than the second switch threshold value T2 (S25: NO), in S29, the controller 20 conducts the first conveying process. The flow proceeds to S37.

In S23, if the second conveying process is not in progress (S23: NO), in other words, if the first conveying process is in progress, in S31, the controller 20 determines whether the measured value Dn is greater than or equal to the first switch threshold value T1.

If the measured value Dn is greater than or equal to the first switch threshold value T1 (S31: YES), in S33, the controller 20 continues the first conveying process. The flow proceeds to S37. If the measured value Dn is smaller than the first switch threshold value T1 (S31: NO), in S35, the controller 20 conducts the second conveying process. The flow proceeds to S37.

In S37, the controller 20 determines whether sheet-jam is detected. If sheet-jam is detected (S37: YES), in S39, the controller 20 sets the sheet-jam flag on. Following S39, or if the sheet-jam is determined not to be on (S37: NO), in S41, the controller 20 determines whether the print job is completed. If the print job is completed (S41: YES), the flow ends thereat. If the print job is not completed (S41: NO), the flow returns to S3.

4. Usability of the Image Forming Apparatus

According to the present embodiment, as shown in FIG. 5, when a measured value Dn falls in a range A, which is between the first sheet length L1 with the maximum measurement error E (L1|E) and the second sheet length L2 with the maximum measurement error E (L2|E), and a next measured value Dn falls in a range between the first sheet length L1 with the maximum measurement error E (L1+E) and the second sheet length L2 with the minimum measurement error E (L2−E), the first conveying process is conducted.

When the measured value Dn falls in a range B, which is between the first sheet length L1 with the minimum measurement error E (L1−E) and the second sheet length L2 with the minimum measurement error E (L2−E), and a next measured value Dn falls in a range between the first sheet length L1 with the maximum measurement error E (L1+E) and the second sheet length L2 with the minimum measurement error E (L2−E), the second conveying process is conducted.

Thus, either the first conveying process or the second conveying process is conducted based on the switch threshold value T. Therefore, excessively frequent switching actions between the two conveying modes may be restrained.

Further, according to the present embodiment, when sheet jam being detected is determined, the first conveying process, in which the circulative number is smaller than the second conveying process, is conducted. Therefore, from the detection of the sheet jam and onward, repetitive sheet jam may be avoided. While the circulative number in the second conveying process is greater than the circulative number in the first conveying process, sheet jam may tend to occur more often in the second conveying process than the first conveying process. Therefore, by conducting the first conveying process when sheet jam occurred, further sheet jam may be avoided.

Second Embodiment

Figure 6:
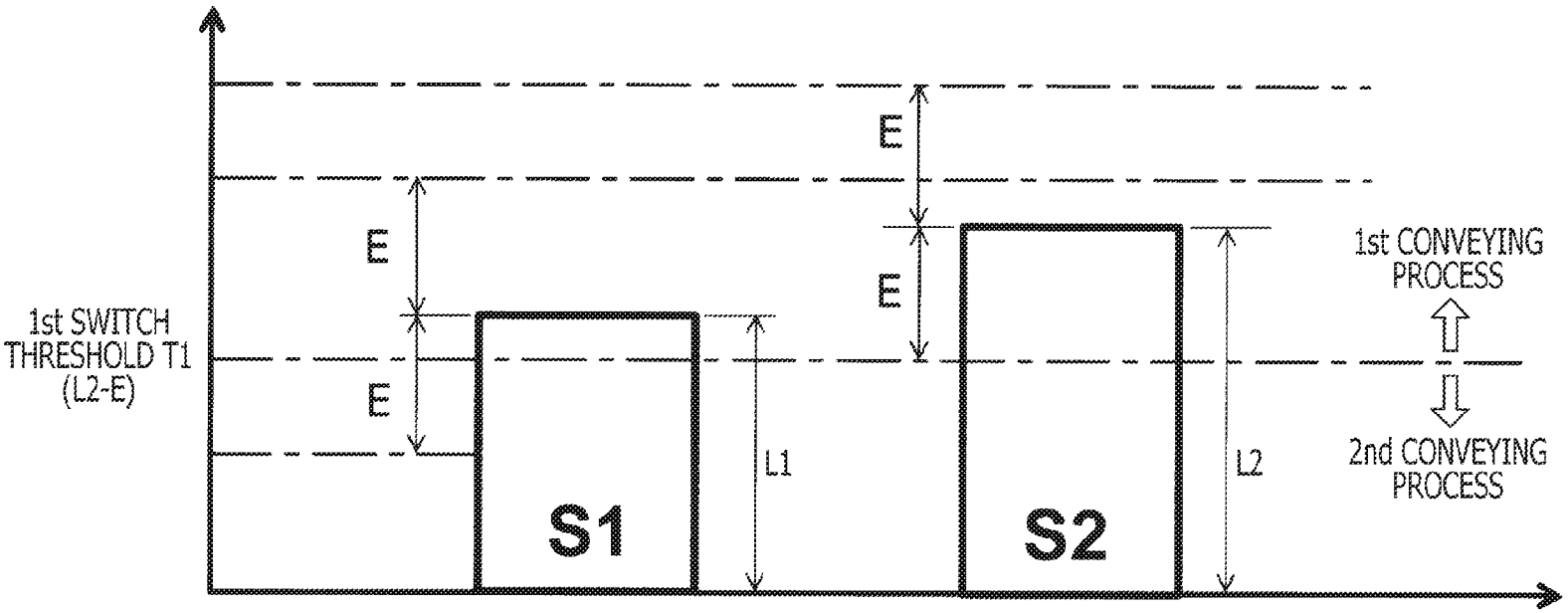
FIG. 6 illustrates relation among sheet lengths, switching thresholds, and conveying modes in the image forming apparatus according to a second embodiment of the present disclosure.

The first switch threshold value T1 may coincide with a minimum value for the second measurement error (L2−E). In other words, the minimum value for the second measurement error (L2−E) may be stored in the memory M as the first switch threshold value T1. In this case, when the measured value Dn is greater than or equal to the first switch threshold value T1, the first conveying process may be conducted; and when the measured value Dn is smaller than the first switch threshold value T1, the second conveying process may be conducted (see FIG. 6). In this regard, there may be a case that the controller 20 cannot determine whether the sheet is the first sheet S1 or the second sheet S2 based on the measured value Dn. In such a case, for example, the first conveying process rather than the second conveying process may be conducted in favor of reducing the risk of sheet jam.

Third Embodiment

Figure 7:
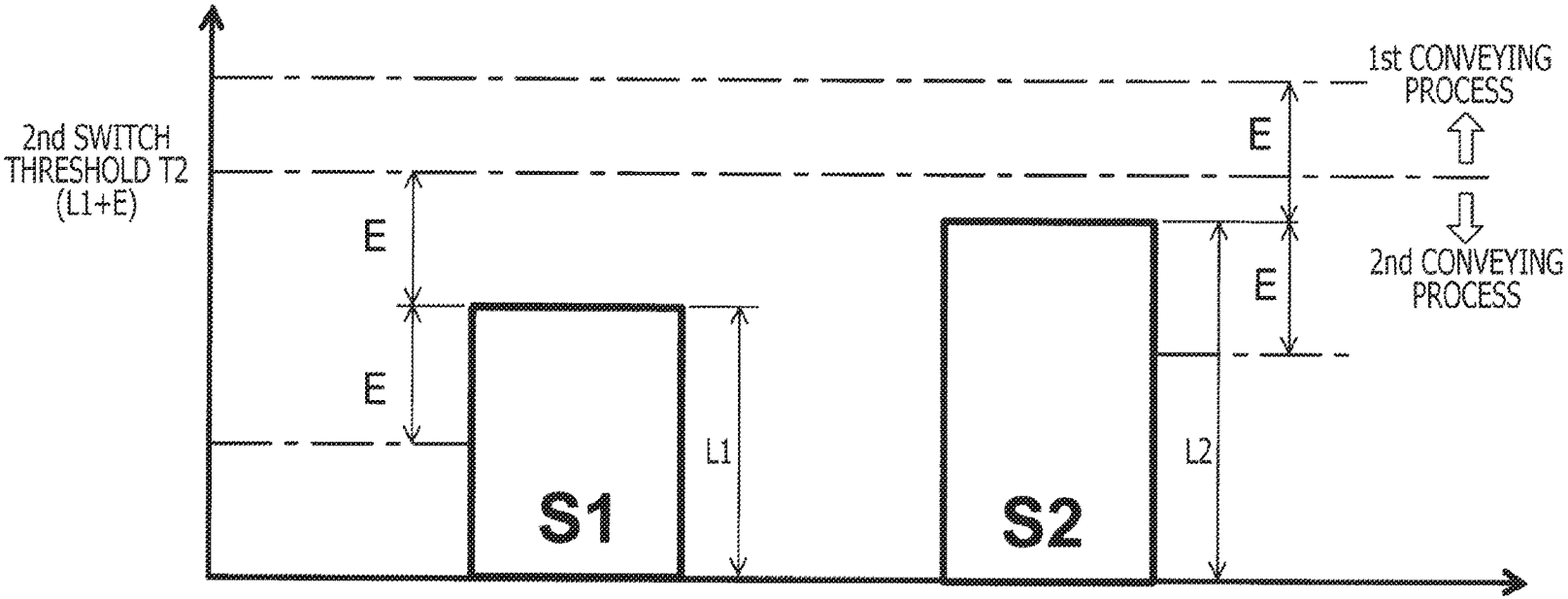
FIG. 7 illustrates relation among sheet lengths, switching thresholds, and conveying modes in the image forming apparatus according to a third embodiment of the present disclosure.

The second switch threshold value T2 may coincide with a maximum value for the first measurement error (L1+E). In other words, the maximum value for the first measurement error (L1+E) may be stored in the memory M as the second switch threshold value T2. In this case, when the measured value Dn is greater than the second switch threshold value T2, the first conveying process may be conducted; and when the measured value Dn is smaller than or equal to the second switch threshold value T2, the second conveying process may be conducted (see FIG. 7). In this regard, there may be a case that the controller 20 cannot determine whether the sheet is the first sheet S1 or the second sheet based on the measured value Dn. In such a case, for example, the second conveying process rather than the first conveying process may be conducted in favor of speed efficiency so that a quantity of sheets to be printed per unit time may be increased.

More Examples

Although examples of carrying out the disclosure have been described, those skilled in the art will appreciate that there are numerous variations and permutations of the image forming apparatus that fall within the spirit and scope of the disclosure as set forth in the appended claims. It is to be understood that the subject matter defined in the appended claims is not necessarily limited to the specific features or act described above. Rather, the specific features and acts described above are disclosed as example forms of implementing the claims.

For example, the image forming apparatus 1 may not necessarily be a monochrome image printing apparatus but may be a multicolor image forming apparatus.

For another example, when sheet jam is determined to be detected, the first conveying process may not necessarily be conducted, but a current conveying process (e.g., the second conveying process) may be continued.

For another example, the controller 20 shown in FIG. 3 may be a collection of hardware devices, including the CPU, which may be used to control behaviors of the image forming apparatus 1 and therefore may not necessarily be a single hardware device. Therefore, for example, the memory M shown in FIG. 3 may be included in the controller 20.

For another example, the sheet sensor SS may not necessarily be an optical sensor but may be a sensor of a different sensing method.

For another example, the determination in S3 in the main flow (see FIG. 4) may not necessarily be made according to the output from the sheet sensor SS5 to detect the opening and closing motion of the feeder tray 17. For example, a tray sensor to detect presence or absence of the sheet placed in the feeder tray 17 may be provided, and the negative determination (S3: NO) may be made when signals from time tray sensor indicating absence of the sheet change to signals indicating presence of the sheet.

For another example, when the sheet length is measured by the sheet sensor SS, the sheet lengths, such as L1+E, L2−E (see FIG. 5), may be stored in the memory M as the switch threshold values T. Further, a distance for the sheet being conveyed may be obtained from a length of time period, in which the sheet sensor SS outputs the second signal, being multiplied by a sheet-conveying speed. Thus, determination between the first conveying process and the second conveying process may be made by comparing the obtained distance with the sheet lengths L1+E and L2−E. For another example, the sheet lengths L1+E and L2−E may be divided by the sheet-conveying speed, and the quotients may be stored in the memory M. The determination may be made by comparing the length of time period, in which the sheet sensor SS outputs the second signal, with the quotients.

What is claimed is:

1. An image forming apparatus, comprising:

an image forming unit configured to form an image on a sheet;

a sheet tray, on which the sheet to be conveyed to the image forming unit is placed;

a discharge tray, on which the sheet being discharged with the image formed thereon is placed;

a conveying unit configured to convey the sheet in a conveying path along a sheet conveying direction, the conveying path comprising:

a first conveying path extending from the sheet tray through the image forming unit to the discharge tray; and a second conveying path branched from the first conveying path at a position downstream from the image forming unit with regard to the sheet conveying direction and merged with the first conveying path at a position upstream from the image forming unit with regard to the sheet conveying direction;

a sheet sensor configured to output a first signal when no sheet is at a predetermined position in the conveying path and to output a second signal when the sheet is at the predetermined position;

a memory device; and a controller configured to conduct:

a measuring process, in which a time period between timing when signals output from the sheet sensor change from the first signal to the second signal and timing when signals output from the sheet sensor change from the second signal to the first signal is measured;

a comparison process, in which a measured value indicating the time period measured in the measuring process is compared with a switch threshold value stored in the memory device, the switch threshold value being a value in a range of a measurement error allowed to the measured value for the sheet; and a conveying process, in which the conveying unit is driven to convey a number of sheets circulating in the conveying path, the conveying process comprising a first conveying process, in which the conveying unit is driven to convey a predetermined number of sheets to circulate in a part of the first conveying path that extends through the image forming unit, the second conveying path, and once again the part of the first conveying path that extends through the image forming unit; and a second conveying process, in which the conveying unit is driven to convey a greater number of sheets than the predetermined number to circulate in the part of the first conveying path that extends through the image forming unit, the second conveying path, and once again the part of the first conveying path that extends through the image forming unit, wherein the sheet comprises a first sheet, of which sheet length is a first sheet length, and a second sheet, of which sheet length is a second sheet length being greater than the first sheet length, the sheet length being a dimension of an area in the sheet being conveyed along a direction in parallel with the sheet conveying direction;

wherein the measurement error comprises a first measurement error allowed to the measured value for the first sheet in the measuring process and a second measurement error allowed to the measured value for the second sheet in the measuring process, a minimum value for the second measurement error being less than or equal to a maximum value for the first measurement error;

wherein the switch threshold value comprises a first switch threshold value, the first switch threshold value being a value greater than a minimum value for the first measurement error and being less than or equal to the minimum value for the second measurement error;

wherein the switch threshold value further comprises a second switch threshold value, the second switch threshold value being a value smaller than a maximum value for the second measurement error and being greater than or equal to the maximum value for the first measurement error; and wherein in the conveying process the controller conducts the first conveying process when the measured value is greater than the second switch threshold value and conducts the second conveying process when the measured value is smaller than the first switch threshold value.

2. The image forming apparatus according to claim 1, wherein the controller conducts the first conveying process when the measured value is one of greater than and equal to the first switch threshold value.

3. The image forming apparatus according to claim 2, wherein the first switch threshold value is equal to the minimum value for the second measurement error.

4. The image forming apparatus according to claim 1, wherein the controller conducts the second conveying process when the measured value is less than or equal to the second switch threshold value.

5. The image forming apparatus according to claim 4, wherein the second switch threshold value is equal to the maximum value for the first measurement error.

6. The image forming apparatus according to claim 1, wherein the controller conducts the first conveying process when the measured value is once greater than the second switch threshold value without experiencing to be smaller than the first switch threshold value and later becomes greater than or equal to the first switch threshold value; and wherein the controller conducts the second conveying process when the measured value is once smaller than the first switch threshold value without experiencing to be greater than the second switch threshold value and later becomes less than or equal to the second switch threshold value.

7. The image forming apparatus according to claim 6, wherein the first switch threshold value is equal to the minimum value for the second measurement error; and wherein the second switch threshold value is equal to the maximum value for the first measurement error.

8. The image forming apparatus according to claim 6, further comprising:

a tray sensor configured to output a third signal when the sheet is in the sheet tray and when the sheet tray is in a position to feed the sheet to the image forming unit, wherein the memory device comprises a control-determination information storing area, in which control-determination information indicating one of the first conveying process and the second conveying process to be conducted by the controller is stored;

wherein the controller conducts:

a storing process, in which, if the memory device contains no control-determination information, the controller stores the control-determination information in the control-determination information storing area in the memory device one of when the measured value is greater than the second switch threshold value and when the measured value is smaller than the first switch threshold value;

a deleting process, in which the controller deletes the control-determination information from the memory device when the tray sensor outputs no third signal;

wherein, once the controller stores the control-determination information in the memory device based on the measured value being greater than the second switch threshold value, and if the measured value changes to be greater than or equal to the first switch threshold value while the control-determination information is maintained stored in the memory device, the controller conducts the first conveying process; and wherein, once the controller stores the control-determination information in the memory device based on the measured value being smaller than the first switch threshold value, and if the measured value changes to be less than or equal to the second switch threshold value while the control-determination information is maintained stored in the memory device, the controller conducts the second conveying process.

9. The image forming apparatus according to claim 8, wherein the controller further conducts a sheet-jam detecting process, in which sheet jam in the conveying path is detectable; and wherein, if sheet jam is detected in the sheet-jam detecting process and if the memory device contains no control-determination information, and if the measured value is greater than or equal to the first switch threshold value and is less than or equal to the second switch threshold value, the controller conducts the first conveying process.

10. The image forming apparatus according to claim 1, wherein the sheet sensor comprises:

a light emitter configured to emit light;

a light receiver configured to output different signals depending on conditions to receive and not to receive the light emitted from the light emitter; and a movable member arranged to extend through the conveying path and configured to move between a blocking position, in which the light emitted from the light emitter toward the light receiver is blocked, and a transmitting position, in which the light emitted from the light emitter is transmitted to the light receiver, depending on a position of the sheet in the conveying path.

* * * * *